United States Patent [19]

Wolfertz

[11] 4,354,588

[45] Oct. 19, 1982

[54] DEVICE ON AN ATTACHMENT MACHINE

[75] Inventor: Günter Wolfertz, Schützenstrasse, Fed. Rep. of Germany

[73] Assignee: Schaeffer-Homberg GmbH, Wuppertal, Fed. Rep. of Germany

[21] Appl. No.: 108,262

[22] Filed: Dec. 28, 1979

[30] Foreign Application Priority Data

Dec. 30, 1978 [DE] Fed. Rep. of Germany ..... 2856868

[51] Int. Cl.[3] ..... B65G 47/24

[52] U.S. Cl. ..... 198/394; 198/491; 198/739; 112/113; 221/171

[58] Field of Search ..... 198/394, 739, 491, 530–532; 221/171, 173; 112/108, 110, 113

[56] References Cited

U.S. PATENT DOCUMENTS

| | | | |
|---|---|---|---|
| 2,248,086 | 7/1941 | Huelster | 221/173 |
| 2,265,574 | 12/1941 | Peterson | 198/394 |
| 2,588,486 | 3/1952 | Clarke | 221/173 |
| 2,595,206 | 4/1952 | Troske | 221/173 |
| 3,089,443 | 5/1963 | Asnes | 112/110 |

FOREIGN PATENT DOCUMENTS

| | | | |
|---|---|---|---|
| 721919 | 1/1955 | United Kingdom | 221/173 |

*Primary Examiner*—Joseph E. Valenza
*Attorney, Agent, or Firm*—Martin A. Farber

[57] ABSTRACT

A device for the correct angular positioning of fasteners such as buttons, rivets or the like in the tool of an attachment machine which has a trough-shaped guide rail for these fasteners arranged in front of the tool, the rail having a curved friction lining over at least part of the length of one side thereof and having, on its opposite side, a side wall which is spring-biased in the direction of the friction lining. A swingable slide is associated with this rail and pushes these fasteners forward which are provided with an indexing stop. A finger on the slide touches the indexing stop of the fastener in one position thereof. The pushing surface of the slide is disposed on the longitudinal center line of the feed trough, and the finger is separable from the slide and is arranged laterally of the longitudinal central line.

13 Claims, 16 Drawing Figures

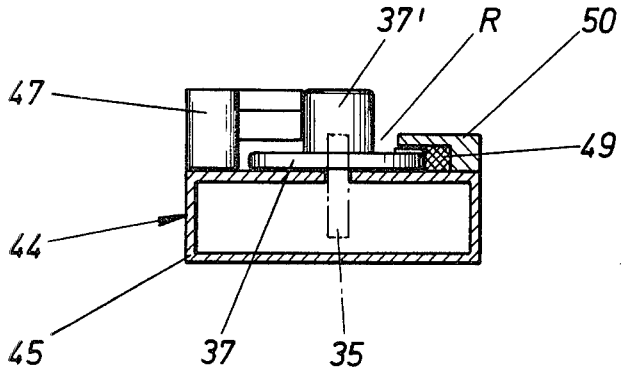
FIG. 4
FIG. 5
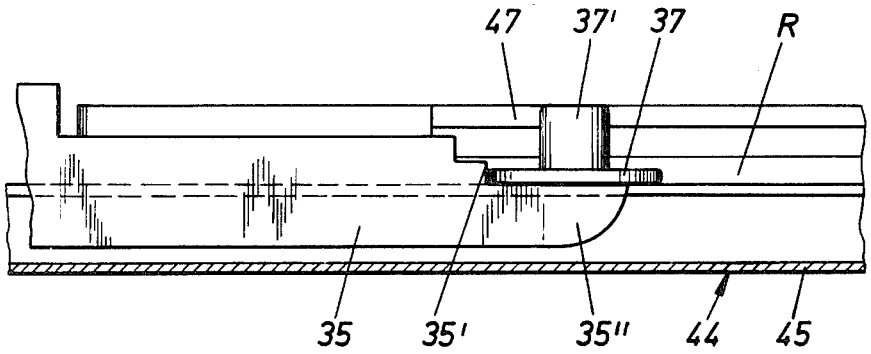
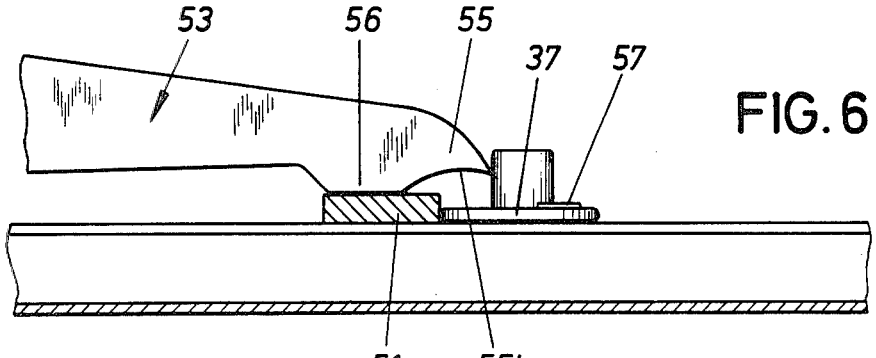
FIG. 6
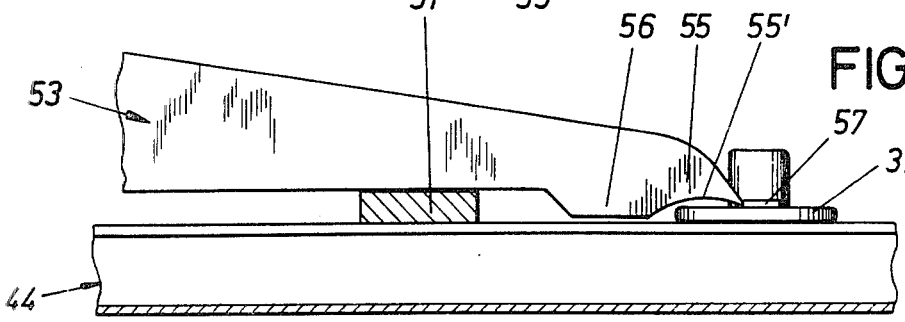
FIG. 7

FIG. 12
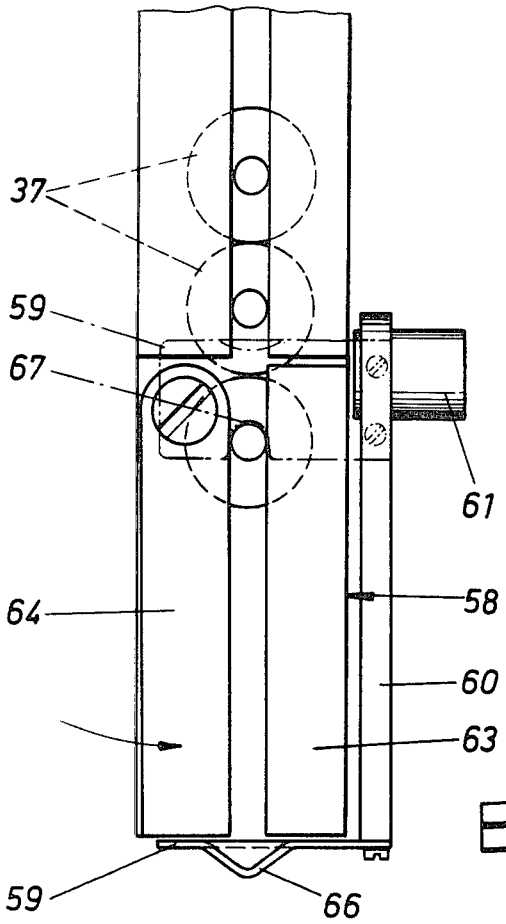
FIG. 13
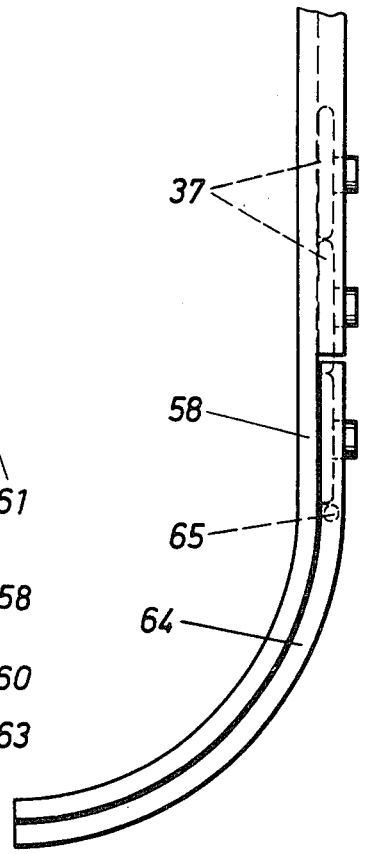
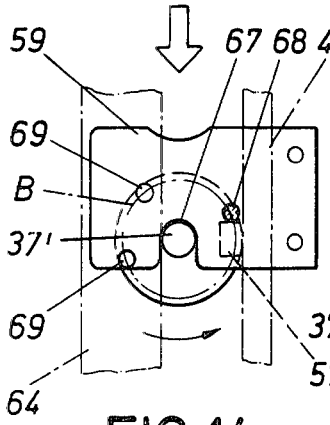
FIG. 14
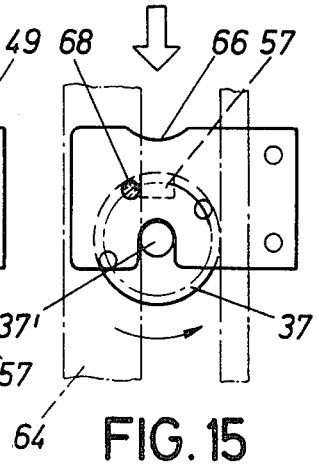
FIG. 15
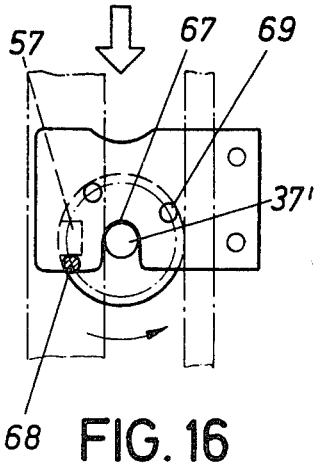
FIG. 16

DEVICE ON AN ATTACHMENT MACHINE

The present invention relates to a device for the positioning of buttons, rivets or the like in correct angular position in the tool of an attachment machine, which has a trough-shaped feed rail, located in front of the tool, for the buttons, rivets or the like, said rail having a friction covering over at least a part of its length on its one side and, on its opposite side, a side wall which is spring-biased in the direction towards the friction covering, and with which there is associated a head or similar forward-pushing slide which is provided with an indexing stop and to a finger which notes the position of the indexing stop of the head or the like.

In one known embodiment, the slide consists of two bars which extend parallel to the longitudinal center line of the feed rail and support between each other the finger which is aligned with the longitudinal center line. The feeding of the button to the tool is effected in the manner that the bars of the slide act on the shank of the button while the central finger extends over the indexing stop. The button can therefore be transferred to the tool only in one angular position. In order to obtain further angular positions, the tool is provided with a drive consisting of a piston, rack and pneumatic cylinder, which makes the construction of the attachment machine expensive.

The object of the present invention is to develop a device of the type in question in a manner simple from the standpoint of manufacture and advantageous in use in that a separate drive for the tool is not required in order to obtain the proper angular positioning of buttons, rivets or the like.

This object is aided in the manner that the feed trough is curved and the slide is pivotally mounted so as to swing along the curved feed trough. The pushing surface (67) of the slide is disposed on the longitudinal center line of the feed trough (R), and the finger (68) is arranged laterally of the longitudinal central line.

As a result of such development, there is obtained a device of the above-mentioned type which is of simplified construction. In contradistinction to the known solution, the buttons, rivets or the like are transferred to the tool already in the desired proper angular position. The cost of manufacture can be kept low as compared with the known solution. The finger, which is responsible for the aligning of the button, is seated merely laterally displaced from the longitudinal center line. During the feed movement in the feed rail it limits the movement of rotation of the button by striking against one edge of the indexing stop of the button. In this position the button is then transferred to the tool. The resilient development of the finger prevents the button whose rotation has been stopped by the finger from leaving its position even if violent blows occur. The transfer of the button to the tool in proper angular position is thus assured at all times. By the advantageous development of the end of the finger which contacts the button, a large pallet of offerings of buttons can be worked. Advantages with respect to the guiding of the slide and the grasping of the button are obtained by the favorable development of the slide.

The principle of the invention can be employed in a favorable manner with a swingable slide. In such case, the throat arranged on the longitudinal central line forms the abutment surface of the slide, while a pin seated on the slide assumes the function of the finger. In this case also it is possible to feed the button, rivet or the like in the desired angularly correct position. By shifting the pin into one of the different holes in the slide the position can be changed. For example, three interesting angular positions can be obtained with three holes arranged on an arc which is concentric to the throat.

Two preferred illustrative embodiments of the invention will be explained below with reference to the drawings, in which:

FIG. 4 is a cross section through the feed rail in the region of the friction covering;

FIG. 5 is a longitudinal section through the feed rail with button part pushed forward by the slide;

FIG. 6 is a longitudinal section through the feed rail in the retracted position of the slide (not shown) with the finger seated on the shoulder;

FIG. 7 is a view corresponding to FIG. 6 in which the finger has been moved forward and has engaged behind the indexing stop of the button part;

Figures 8, 9, 10:
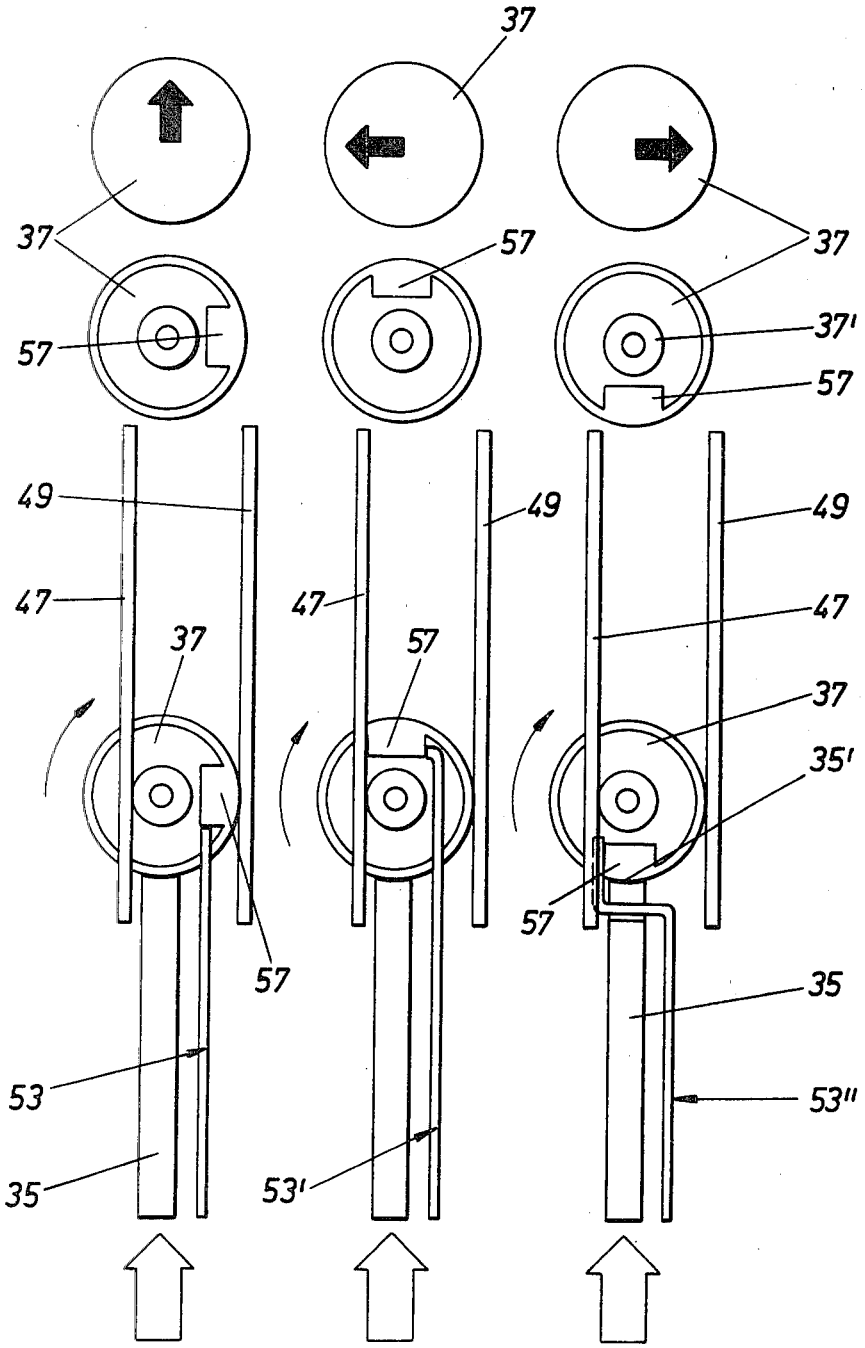
Figure 11:
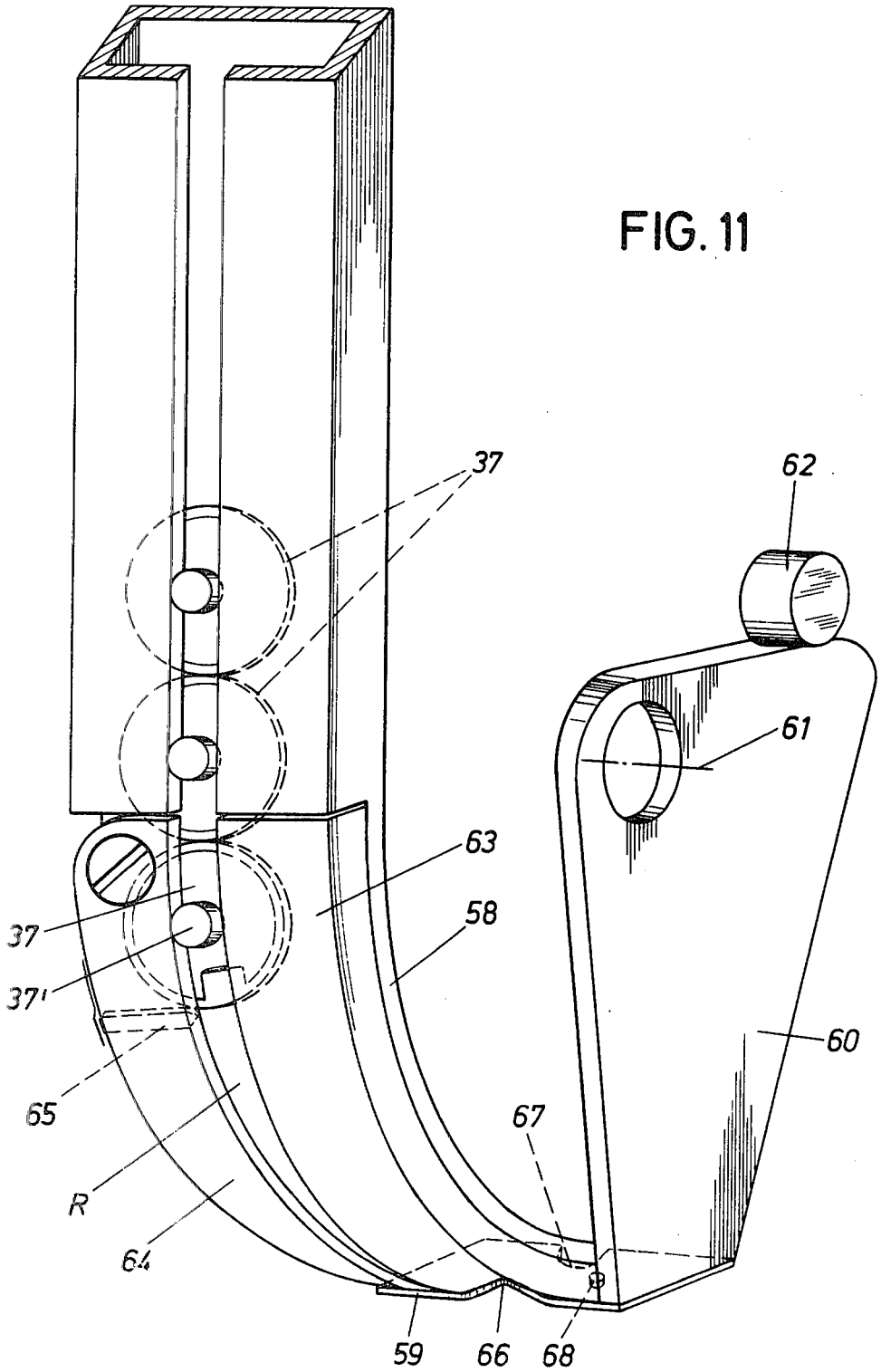

FIGS. 8 to 10 diagrammatically show the device with three differently shaped fingers for obtaining three different angular positions of the button parts, the angular positions being indicated by arrows on the button parts;

FIG. 11 shows, in perspective, a modified embodiment in which the end of the feed rail is curved and the slide swings along this curve;

FIG. 12 is an end view of the curved feed rail;

FIG. 13 is a side view of FIG. 12; and

FIGS. 14 to 16 show diagrammatically the slide seated on the swing arm, with which the finger associated as pin is associated in three different positions.

The attachment machine has a stand 2 carried by the base plate 1. On this stand there is supported the actuating pedal 3 which, via a rod not shown in the drawing, introduces the operating stroke of the attachment machine.

The machine housing 4 is seated on the stand 2. The housing contains, at the bottom, the extension 5 which bears the bottom tool 6 on its free end. The ram 7, which is guided in two small bearing brackets 8 and 9 located on the machine, extends in alignment with the bottom tool 6. In the region between the bearing brackets 8 and 9 there is a roller 10, mounted on the ram 7. The end of the ram 7 which extends above the bearing bracket 9 carries the stop arm 11 clamped thereon, the free end of which is provided with the support roller 12.

Below the roller 10 there is slideably arranged on the ram 7 a carriage 13 which is urged in upward direction by a tension spring 14. A stop limitation is provided for the carriage 13 in upward direction by means of the head 15 of the screw 16 which extends from the lower bearing bracket 8. On both sides of the carriage 13 there are present leaf springs 17 which bear the gripper jaws 18 at their end.

The bearing bracket 8 furthermore serves as a support for the screw 19 whose head 20 limits the downward displacement of the carriage 13 which is carried along by the upper tool 21. The downward displacement of the carriage 13 results from the fact that the upper tool 21 which is seated on the ram 7 comes against the inner flanks of the gripper jaws 18.

The working stroke of the ram 7 is obtained by a wedge 22 of fork-shaped development, the two fork arms of which form, on the bottom, two oblique surfaces 23 and 24 which adjoin each other. The top side of the fork arms lying opposite these oblique surfaces serves as supporting surface against which the abutment roller 26 arranged on the machine comes. The piston rod 27 of a pneumatic piston 28 which receives its support by the bearing bracket 29 on the machine acts on the wedge 22.

The support roller 12 of the stop arm 11 is acted on by the bell-cranklever 31 which swings around the fixed pin 30 and is under the action of a return spring 32. This bell-crank lever forms, with the connecting rod 33 extending from it, the transmission system for the tool slides 34 and 35. The tool slide 34 brings the button parts 36 to the gripper jaws 18 while the slide 35 located below it displaces the button parts 37 towards the bottom tool 6. The button parts 36, 37 are stored in a magazine 38 which has magazine chambers arranged one above the other. A slide 39 is associated with said chambers. The upward and downward movement of the slide 39 is produced by a lift cylinder 40. From the magazine 38, the button parts 36 and 37 pass via guide rails 41, 42 to the tools. It is important that the bottom parts 37 be transferred to the lower tool 6 in proper angular position.

For this purpose, the guide rail 41 opens up in front of a transverse opening 43 of a trough-shaped feed rail 44 which is arranged in front of the bottom tool 6. This feed rail has a slit box form 45 within which the slide 35 is longitudinally guided. The box form 45 supports, around the pin 46, a single-end swing-lever 47 which is acted on by a spring (not shown) causing it to swing in the direction of the feed trough R.

On the side of the feed trough R opposite the swing-lever 47 a friction lining 49 extends. It is held and gripped by the cover rail 50. The transverse opening 43 which opens into the feed rail is formed on the one side by a shoulder 51 and on the other side by the cover rail 50.

The button part 37 which passes through the feed trough rests by means of its button edge against the friction covering 49 while the swing-lever comes against the button shank 37'.

The moving of the button part 37 passing through the transverse opening 43 forward to the bottom tool 6 is effected by the slide 35. For this purpose it is provided with a pushing surface 35' located at the height of the edge of the button, which surface acts against the button part 37 in the longitudinal central line of the feed trough R. The slide 35 then continues, via this pushing surface 35' into a nose 35'' which engages below the button 37; see FIG. 5.

The finger 53 is swingably arranged around the journal pin 52 on the slide 35. The finger is under the action of a spring 54 which forces the free, beak-shaped end 55 of the finger in the downward direction. The beak-shaped end 55 forms a concave throat 55'.

Figure 1:
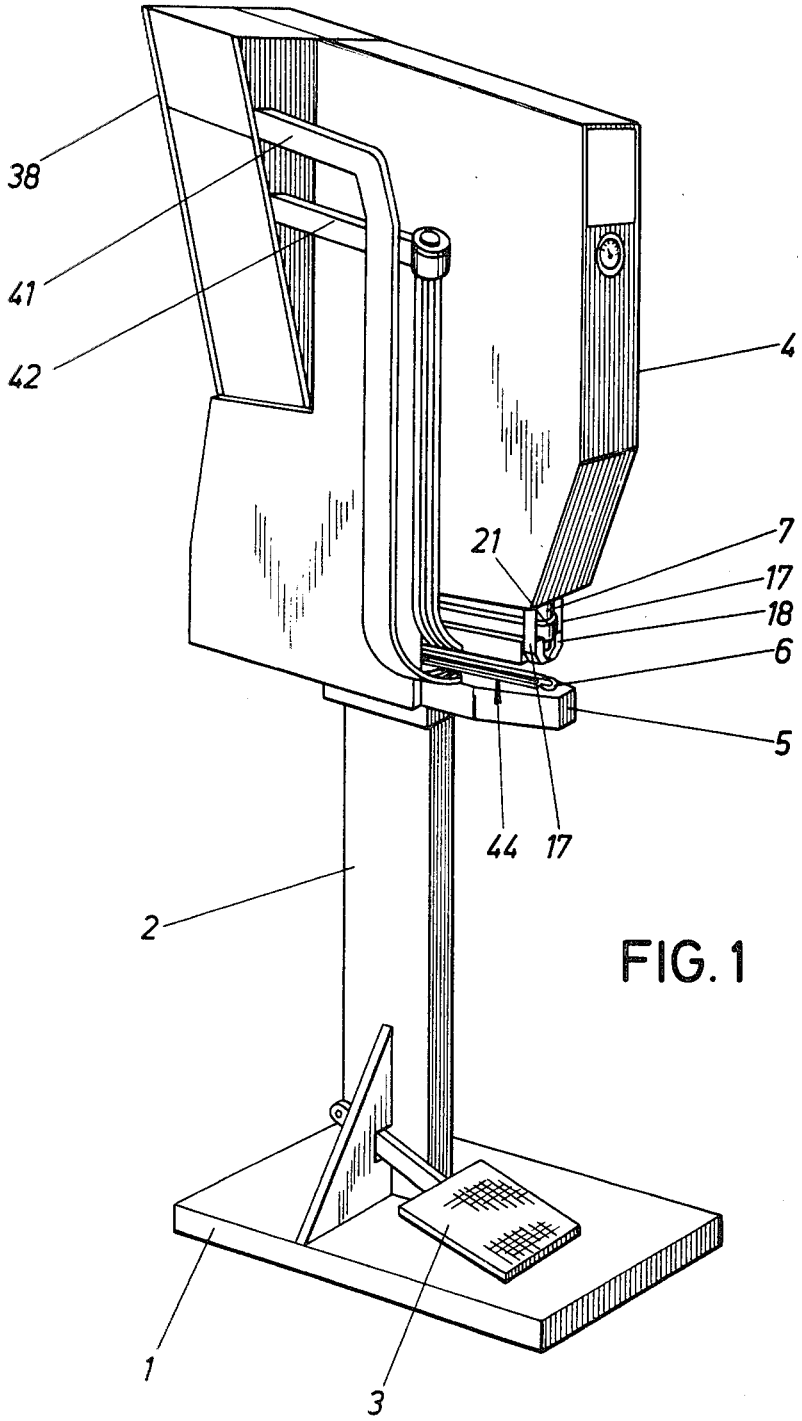
FIG. 1 is a perspective view of the attachment machine in which the button parts are transferred to the tool by means of longitudinal guides.
Figure 2:
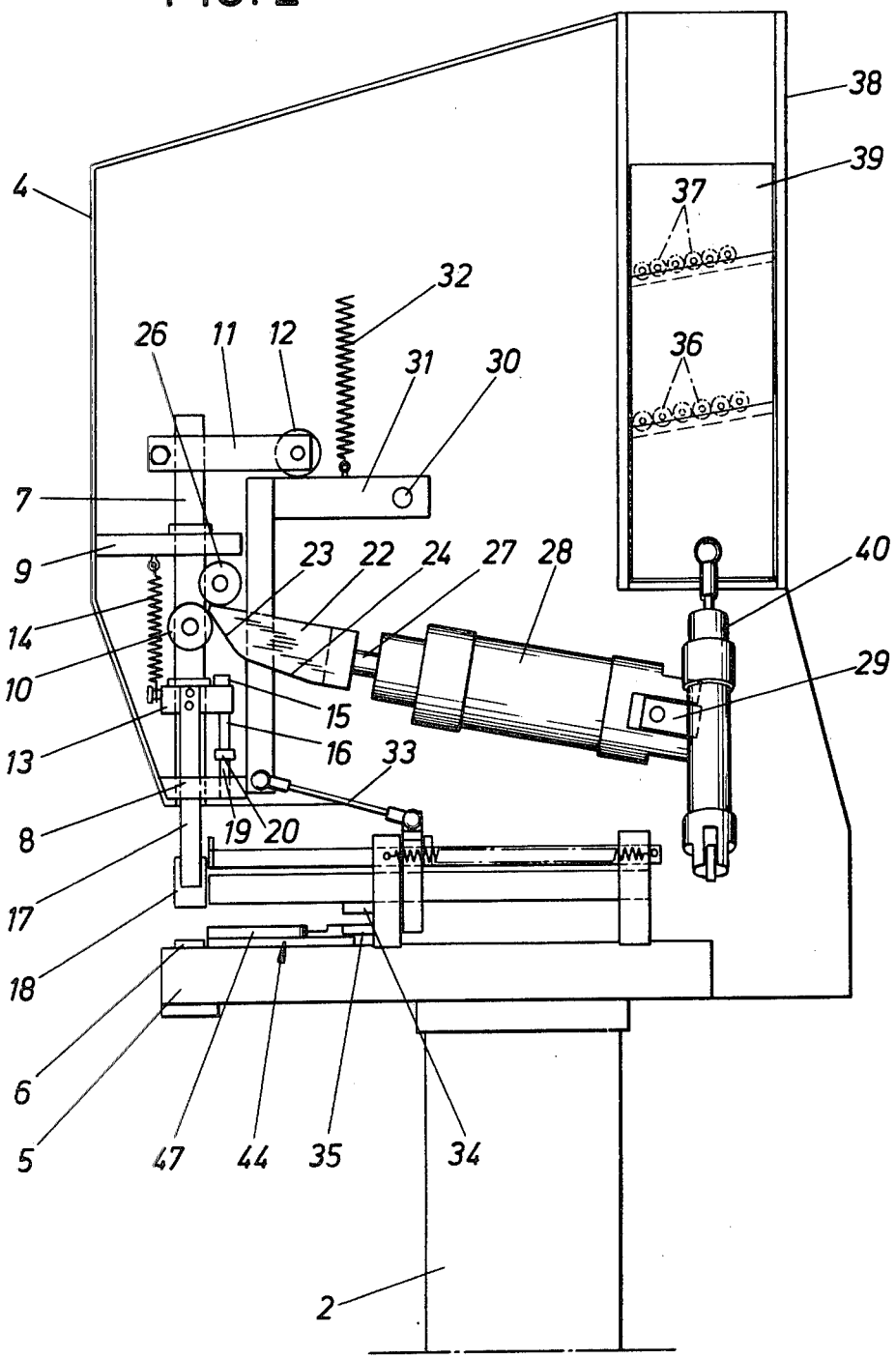
FIG. 2 is a side view of the drive of the attachment machine, seen in its basic position.
Figure 3:
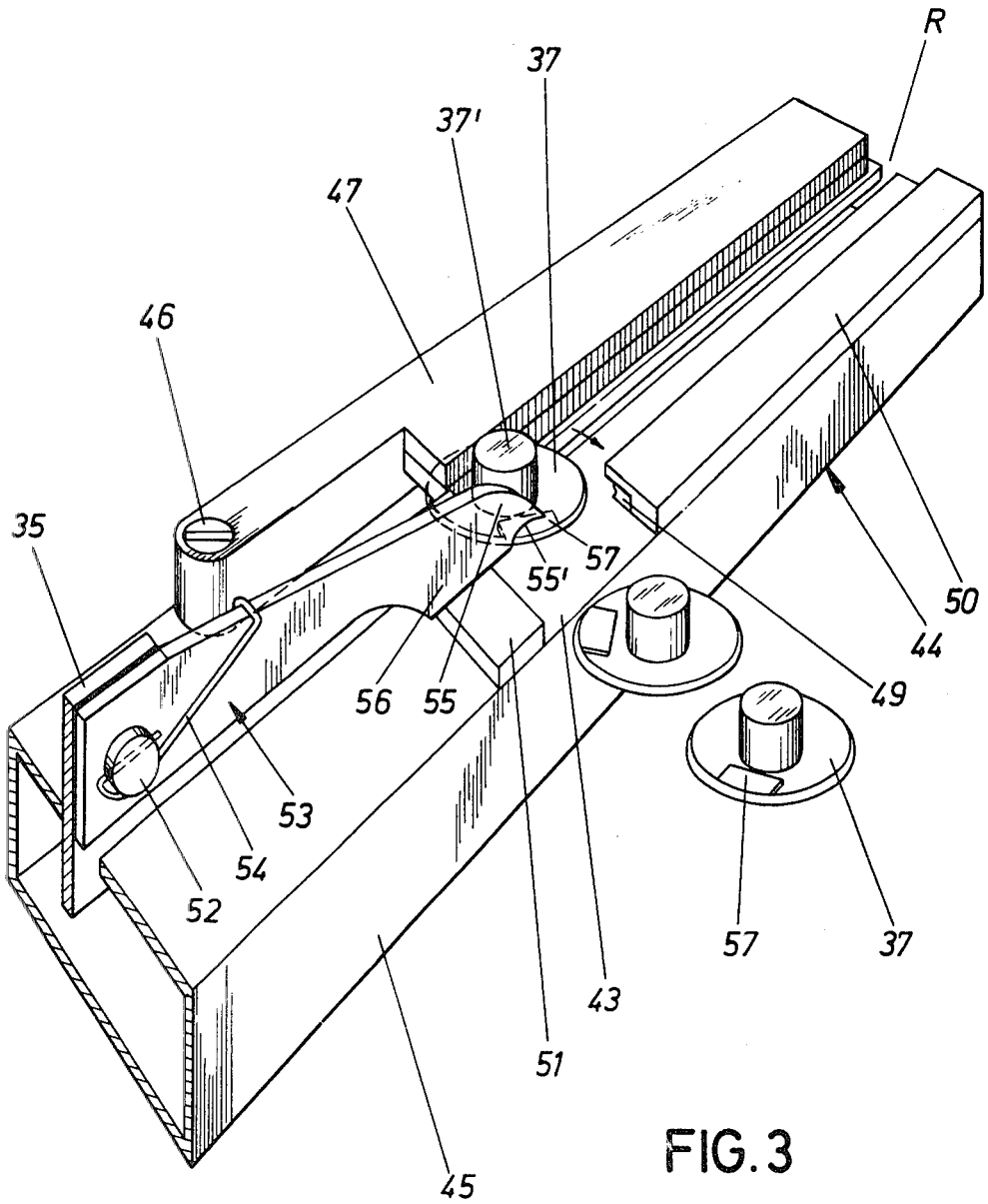
FIG. 3 is a perspective view of the device for the proper angular positioning of the buttons, shown in the retracted position of the slide.

In the retracted position of the slide 35 the finger rests via the projection 56 against the shoulder 51; see FIGS. 3 and 6. Therefore the button 37 can pass through the transverse opening 43 and enter into the feed trough R. The bottom of the button 37 is provided with an indexing stop 57 which agrees with a legend on the button top which is marked by an arrow. Upon the advance of the slide 35, its pushing surface 35' strikes centrally against the edge of the button 37 while the finger 53, due to its raised position resulting from the shoulder 51, still has no effect on the button 37. The button 37 is imparted rotation in the direction indicated by the arrow by the friction lining 49 and the swing arm 47. When the finger 53 has left the shoulder 51 it can swing towards the button. The turning movement of the button is limited when the beak-shaped end 55 strikes against the edge of the indexing stop 57; see FIG. 7. In this position, the button 3 is turned over to the lower tool 6. At the same time, the other button part 36 is fed to the upper tool so that thereupon the attachment process can take place, namely by the moving downward of the ram 7, caused by the wedge 22.

FIGS. 8 to 10 show three different versions of the slide 53, 53' and 53''. The same button part 37 can therefore be aligned in such a manner that the legend indicated by an arrow which is present on the button top assumes different alignments which correspond to the applicable positions of attachment. As indicated in FIG. 10, the pushing surface 35' which is set back with respect to the finger makes it possible to place the end of the finger 53'', which holds the button part 37 on the other side of the slide 35.

The variant shown schematically in FIGS. 11 to 16 shows a curved guide trough 58. From it, the button part can be transferred to an upper tool or to the gripping jaws 18. The slide 59 moves along the curve of the guide trough and is seated on a swing lever 60 which in its turn is swingable around a pin 61 secured to the machine. A stop pin 62 on the machine limits the position of the swing lever 60 in one direction. The curved guide trough 58 also has a cover rail 63 which grips over the friction covering 49. The swing arm 64, developed as a spring-actuated side wall, acting in the same manner as in the embodiment described above, lies opposite the cover rail 63. The button parts 37 which enter into the feed trough R are initially prevented from moving further by a spring-actuated stop pin 65. The slide 59 which consists of spring material moves, as a result of its entrance trough 66, over the button shank 37' and passes into the position shown in dashed line in FIG. 12. The throat 67 of the slide 59 engages behind the button shank 37' in this position. When the slide 59 thereupon swings in the downward direction, the throat 67 carries the button part 37 with it. Due to the friction lining 49 (not illustrated in FIGS. 11 and 12, but the same is in the previous embodiment) the button part 37 is turned. This rotation is limited when the pin 68 serving as a stop and extending from the slide 59 through a suitable slot (not shown) in the cover rail 63 comes against an edge of the indexing stop 57 of the button part 37. The button part is then transferred to the tool in this aligned position.

FIGS. 14, 15 and 16 show that the pin 68 lies on an arc B which is concentric to the throat 67. On this arc there are provided three holes 69 into which the pin 68 can be inserted, as required, in order to maintain the different alignments of the button part in the tool. FIGS. 14 to 16 show the pin 68 in three different positions with respect to the slide 59. If necessary, further holes could be provided in the slide 59.

I claim:

1. A device for transportation and correct angular positioning of fasteners such as buttons, rivets or the like in the tool of an attachment machine which has a trough-shaped guide rail defining a feed trough for the fasteners provided with an indexing stop, which is arranged in front of the tool, the rail having a friction lining over at least part of the length of one side thereof and having, on its opposite side, a side wall which is spring-biased in a direction of the friction lining, comprising slide means disposed along said rail for pushing forward the fasteners, respectively, along said feed trough, said slide means having a pushing surface therefor, said pushing surface being disposed on a longitudinal center line of the feed trough and adapted to engage said fasteners, respectively, stop means for contacting the indexing stop on the fasteners, said stop means comprises a pin arranged on said slide means and laterally of said longitudinal center line, said feed trough defines a curve, a swing lever being pivotally mounted about a stationary pivot axis and having a free end for swinging substantially along said curve of said feed trough, said slide means is arranged at said free end of said swing lever so as to swing substantially along said curve of said feed trough and is adapted to get behind said fasteners for pushing the latter by said pushing surface, said pushing surface of said slide means is formed as an abutment surface.

2. The device according to claim 1, wherein said slide means is formed with a plurality of different holes, said pin is placeable in said different holes selectively.

3. The device as set forth in claim 1, wherein said pushing surface of said slide means is formed as a throat having said abutment surface.

4. The device according to claim 3, wherein said plurality of different holes lie on an arc which is concentric to said throat.

5. The device as set forth in claim 1, wherein said feed trough is formed such that a shank of each of said fasteners extends therefrom, said slide means is resilient and mounted at said free end on said swing lever in a position relative to said feed trough so as to engage said shank of said fasteners simultaneously traveling thereover during return stroke swinging of said lever in a direction toward operative engagement of said pushing surface against said shank.

6. The device as set forth in claim 3, wherein said feed trough is formed such that a shank of each of said fasteners extends therefrom, said slide means is resilient and mounted at said free end on said swing lever in a position relative to said feed trough so as to engage said shank of said fasteners simultaneously traveling thereover during return stroke swinging of said lever in a direction toward operative engagement of said pushing surface against said shank.

7. The device as set forth in claim 3 or 6, wherein said slide means forms an entrance trough located on said slide means opposite said throat adapted to initially guide said slide means for traveling over said fasteners during return stroke swinging of said lever in a direction toward operative engagement of said pushing surface against said shank.

8. The device as set forth in claim 5 or 6, wherein said slide means is a plate formed of spring material.

9. The device as set forth in claim 5, wherein said slide means is spring-biased in a direction towards said shank.

10. The device as set forth in claim 5, wherein said slide means forms an entrance trough located on said slide means opposite said throat adapted to initially guide said slide means for traveling over said fasteners during return stroke swinging of said lever in a direction toward operative engagement of said pushing surface against said shank, said entrance trough projects in a direction away from said shank.

11. The device as set forth in claim 10, wherein said entrance trough and said throat are each symmetrically formed with respect to said longitudinal center line.

12. The device as set forth in claim 5, wherein said throat defines a circular arc complementary to a cross-sectional portion of said shank.

13. The device as set forth in claim 1, wherein said slide means has an inclined portion projecting away from said fasteners and located opposite said pushing surface adapted to initially guide said slide means for traveling over said fasteners during return stroke swinging of said lever in a direction toward operative engagement of said pushing surface against said shank.

* * * * *